US006327955B1

(12) United States Patent
Kerdraon et al.

(10) Patent No.: US 6,327,955 B1
(45) Date of Patent: Dec. 11, 2001

(54) ACTIVE PROTECTION DEVICE FOR THE WALL OF A VEHICLE OR A STRUCTURE

(75) Inventors: Alain Kerdraon, Bourges; Michel Vives, Saint Ambroix; Jean-Paul Toussirot, Saint Mande; Gérald Lefebvre, Velizy, all of (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/447,046

(22) Filed: Nov. 23, 1999

(30) Foreign Application Priority Data

Nov. 23, 1998 (FR) ..... 98 14748

(51) Int. Cl.[7] ..... F41H 5/007
(52) U.S. Cl. ..... 89/36.17
(58) Field of Search ..... 89/36.01, 36.08, 89/36.17

(56) References Cited

U.S. PATENT DOCUMENTS 3,893,368 7/1975 Wales, Jr. ..... 89/36.17
4,051,763 * 10/1977 Thomanek ..... 89/36.17

FOREIGN PATENT DOCUMENTS 117865 8/1900 (DE) .
977 984 9/1974 (DE) .
23 37 248 2/1975 (DE) .
9 78 036 9/1976 (DE) .
29 06 378 C1 11/1990 (DE) .
42 26 897 C1 11/1998 (DE) .

* cited by examiner

*Primary Examiner*—Stephen M. Johnson
(74) *Attorney, Agent, or Firm*—Oliff & Berridge, PLC

(57) ABSTRACT

An active protection device for a surface, the device having at least one casing enclosing at least one shaped charge having a direction of action substantially parallel to or else inclined with respect to the surface as well as detection device ensuring the triggering of the shaped charge in response to the onset of a projectile. The casing encloses four dihedral shaped charges forming a quadrilateral, or four groupings of shaped charges, and having converging directions of action, the directions of action of the shaped charges can be inclined with respect to the surface and oriented towards the outside of the surface.

18 Claims, 10 Drawing Sheets

ACTIVE PROTECTION DEVICE FOR THE WALL OF A VEHICLE OR A STRUCTURE

BACKGROUND OF THE INVENTION

The technical scope of the invention is that of active protection devices for a wall, notably of a vehicle wall.

We know, notably by patent FR-A-2,436,361 a (so-called reactive) protection device that is intended to be fastened to the outer wall of an armored vehicle. This device comprises a sheet of explosive placed between two metallic plates.

When the jet of a shaped charge impacts on the outer metallic plate, the explosive it contains is ignited. Its detonation cause the metallic plate to be projected outwards towards the jet, thereby consuming it and hence reducing its piercing capability. Such a type of armor is not effective enough against APFSDS projectiles or against cores generated by explosively-formed projectiles.

Indeed, as far as the APFSDS projectiles are concerned, the time of interaction between the projected plate and the projectile is much too short for the piercing capability of the projectile to be sufficiently reduced.

With respect to explosively-generated cores, more often than not the cores pass through the reactive armor without igniting the explosive.

Solutions are sought to overcome such drawbacks.

Thus, patents FR-A-2,730,805 and FR-A-2,679,022 propose the combination of reactive armor with a device to detect the onset of the projectile. The plate is projected onto the projectile before it has impacted the armor. The disturbance to the projectile is thus much greater.

However, such armors have further drawbacks. The protective modules are firstly too heavy since they implement substantial masses of explosive and multiple armor plates.

It is therefore not possible to ensure the protection of light vehicles using such devices, nor is it possible to protect tank turrets against attacks from the roof. Nor are these devices able to be used to ensure protection against explosively-formed projectiles.

Indeed, the detection of the onset of the core is very complicated because of its small dimensions (length less than 120 mm, diameter less than or equal to 40 mm).

Reactive armor known by patent FR-A-2,436,361 is more particularly intended for protection against shaped charges. However, they are presently ineffective against so-called tandem charges (described, for example, by patent FR-A-2,577,037). Indeed, these charges incorporate a main rear charge associated with a small front charge whose purpose is to ignite the reactive armor before the arrival of the rear charge, or else to pierce a hole in the reactive armor without igniting it thereby allowing the jet from the main charge to pass through without disturbance.

SUMMARY OF THE INVENTION

The aim of the invention is to propose an active protection device that does not have such drawbacks.

Thus, the protection device according to the invention is both lighter and more compact than known devices, thereby allowing its installation on lightly-armored vehicles and on turrets.

The subject of the invention is thus an active protection device for a wall, notably a vehicle wall, comprising at least one shaped charge having a direction of action substantially parallel or else inclined with respect to the vehicle wall as well as detection means ensuring the triggering of the shaped charge in reply to the onset of a projectile, wherein such device incorporating at least four shaped charges arranged in at least one casing, said shaped charge being arranged on one side of a quadrilateral.

According to a first embodiment, the casing can enclose four dihedral shaped charges forming a quadrilateral and having converging directions of action.

One of the advantages of this first embodiment of the invention implementing dihedral charges lies in that it ensures better protection than known devices against APFSDS projectiles and even against cores generated by shaped charges.

The directions of action of the shaped charges can be inclined with respect to the vehicle wall and oriented towards the outside of the vehicle.

The detection means can comprise at least one panel comprising at least two electrical contacts closed off by the impact of a projectile.

The detection means can also comprise four independent contact panels, each panel controlling the triggering of a different dihedral charge.

The detection means can comprise at least one panel incorporating a conductor cable broken by an impacting projectile.

Advantageously, the detection means can comprise at least two cables broken by the impact of a projectile, each cable being arranged such as to go alternatively from a first edge of the panel to a second edge parallel to the first making a cover of the panel by means of a network of substantially parallel lines, the lines of the network being formed by a first cable perpendicular to those of the network formed by a second cable such as to form a grid on the panel surface.

The detection means can in that case also comprise a control system to ensure measurement of the resistance of the detection cables, such as to locate the impact point of the projectile on the panel, and that controls the triggering of the dihedral charge nearest the point of impact.

According to a variant embodiment, delay means can be provided to ensure the sequential ignition of the other charges after the ignition of a first charge.

According to a second embodiment of the invention, the active protection device is characterized in that the casing encloses at least four cylindrical shaped charges, each of such charges being arranged on the side of a quadrilateral and the directions of action of such charges being inclined with respect to the vehicle wall.

According to this second embodiment, the invention ensures a protection against shaped charges and notably against tandem shaped charges.

The device according to the invention can incorporate at least two casings and the detection means can comprise at least one electromagnetic or optical central sensor, such sensor being connected to computation means that determine the approach direction of a projectile and its velocity and that controls the ignition of at least one charge from one of these casings.

BRIEF DESCRIPTION OF THE DRAWINGS

Other advantages of the invention will become apparent after reading the following description of embodiments, such description being made with reference to the appended drawings in which.

DETAILED DESCRIPTION OF PREFERRED EMBODIMENTS

Figure 1A:
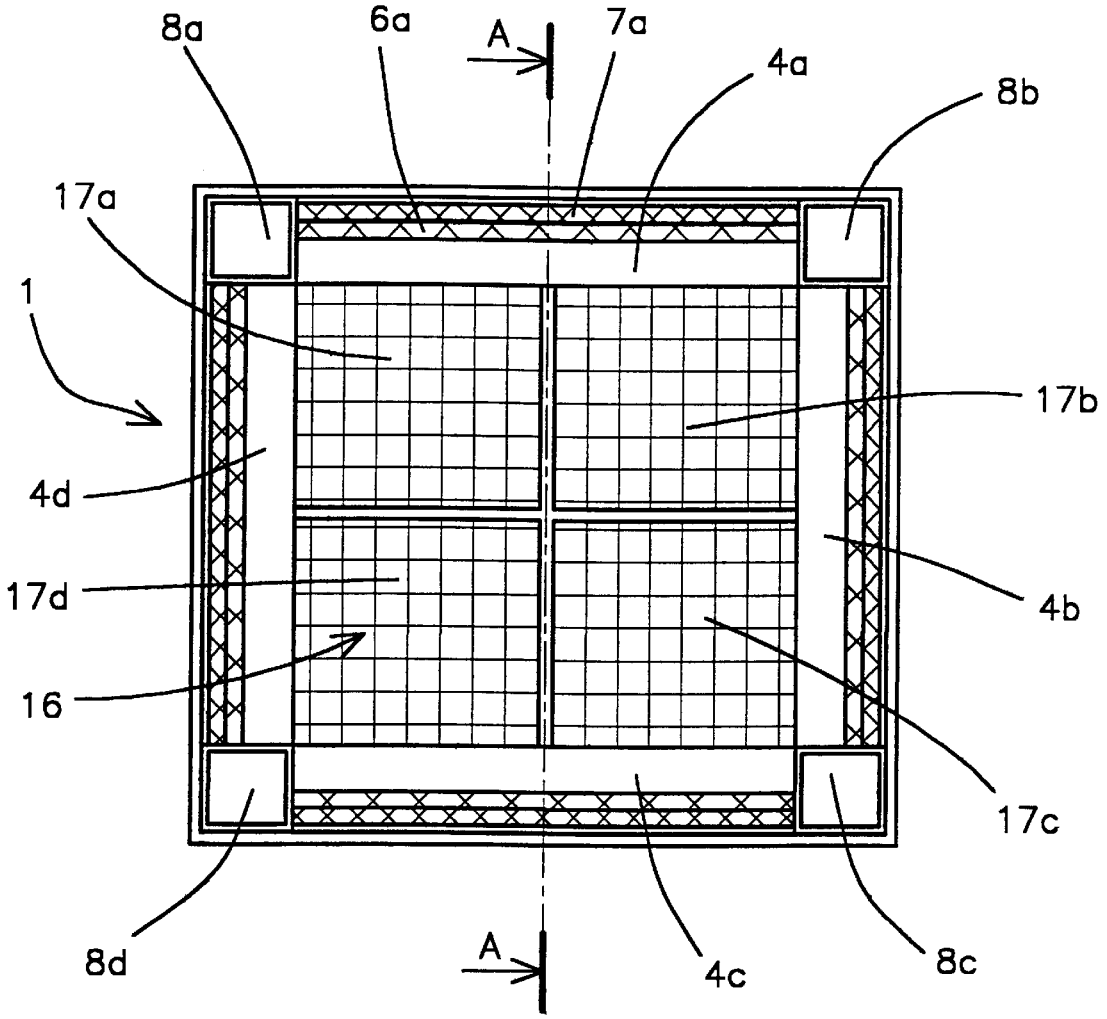
FIG. 1*a* shows a front view of a casing of a protection device according to the invention.
Figure 1B:
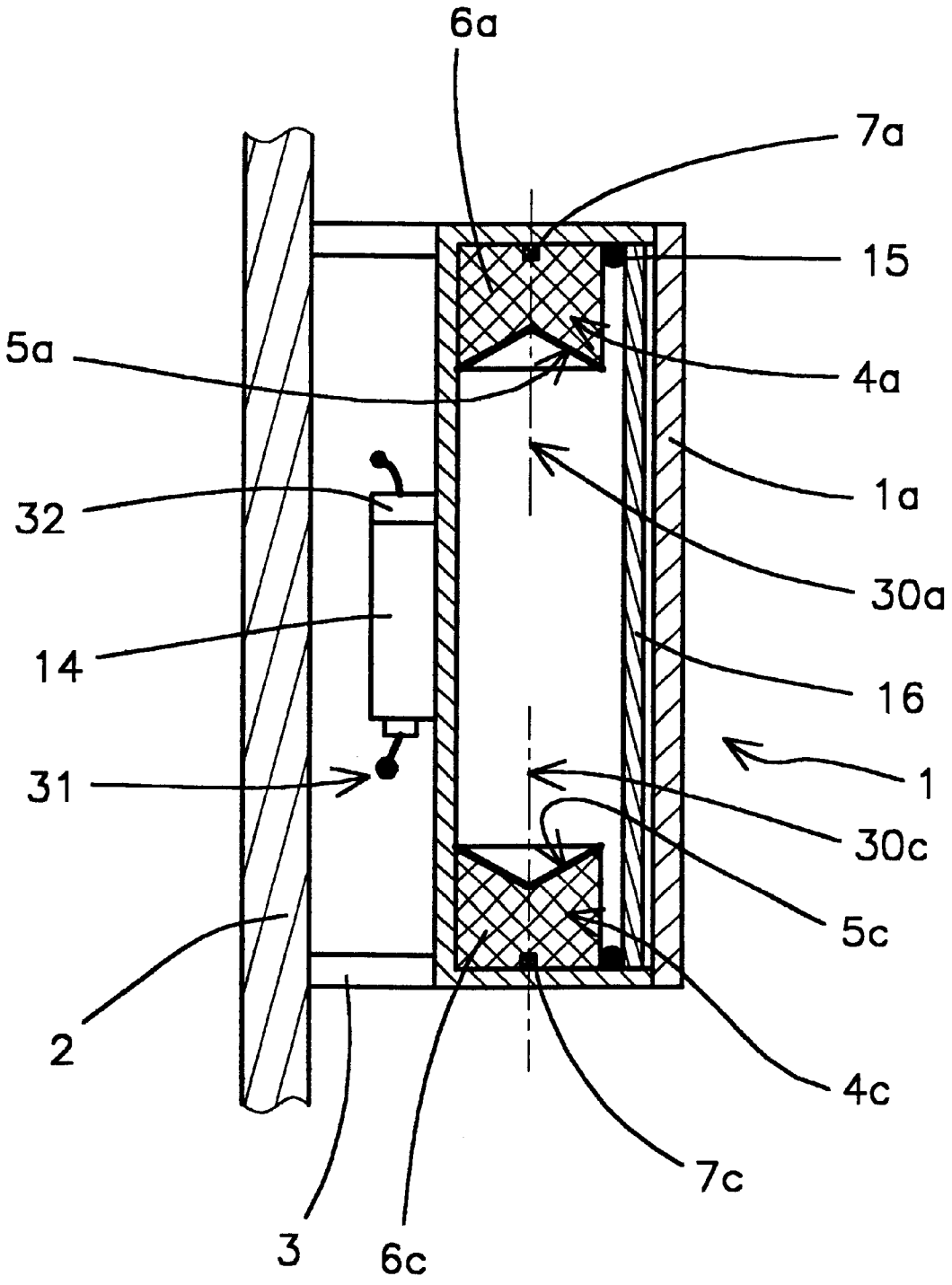
FIG. 1*b* is a section view of this same casing along plane AA as shown in FIG. 1*a,*

With reference to FIGS. 1*a* and 1*b*, an active protection device according to a first embodiment of the invention comprises a parallelepipedic casing 1 fastened to a wall 2 of the vehicle by removable connecting lugs 3. The casing will preferably be made of a light alloy or of a composite material that can also provide protection against shrapnel.

The casing 1 comprises an inner housing closed by a cover 1*a*, fastened to the casing body by fastening means not shown (such as screws). It encloses four dihedral shaped charges 4*a*, 4*b*, 4*c* and 4*d* that are arranged along the inner edges of the casing and each substantially cover the full length of one edge of the casing, the dihedral charges thereby forming a quadrilateral.

The directions of action 30*a*, 30*b*, 30*c* and 30*d* of the different charges converge towards the center of the quadrilateral that they delimit.

Each shaped charge 4 comprises a liner 5 applied to a block of explosive 6 (for example, octol). The explosive is ignited by a priming relay 7 (for example, in RDX-wax) that is itself ignited by a primer integrated into a safety and arming device 8.

On the figures, indices a, b, c and d have been given to the different constitutive elements of each dihedral charge. Thus charge 4*a* comprises an explosive 6*a*, ignited by a cord 7*a*, itself connected to a safety and arming device 8*a*.

Figure 7:
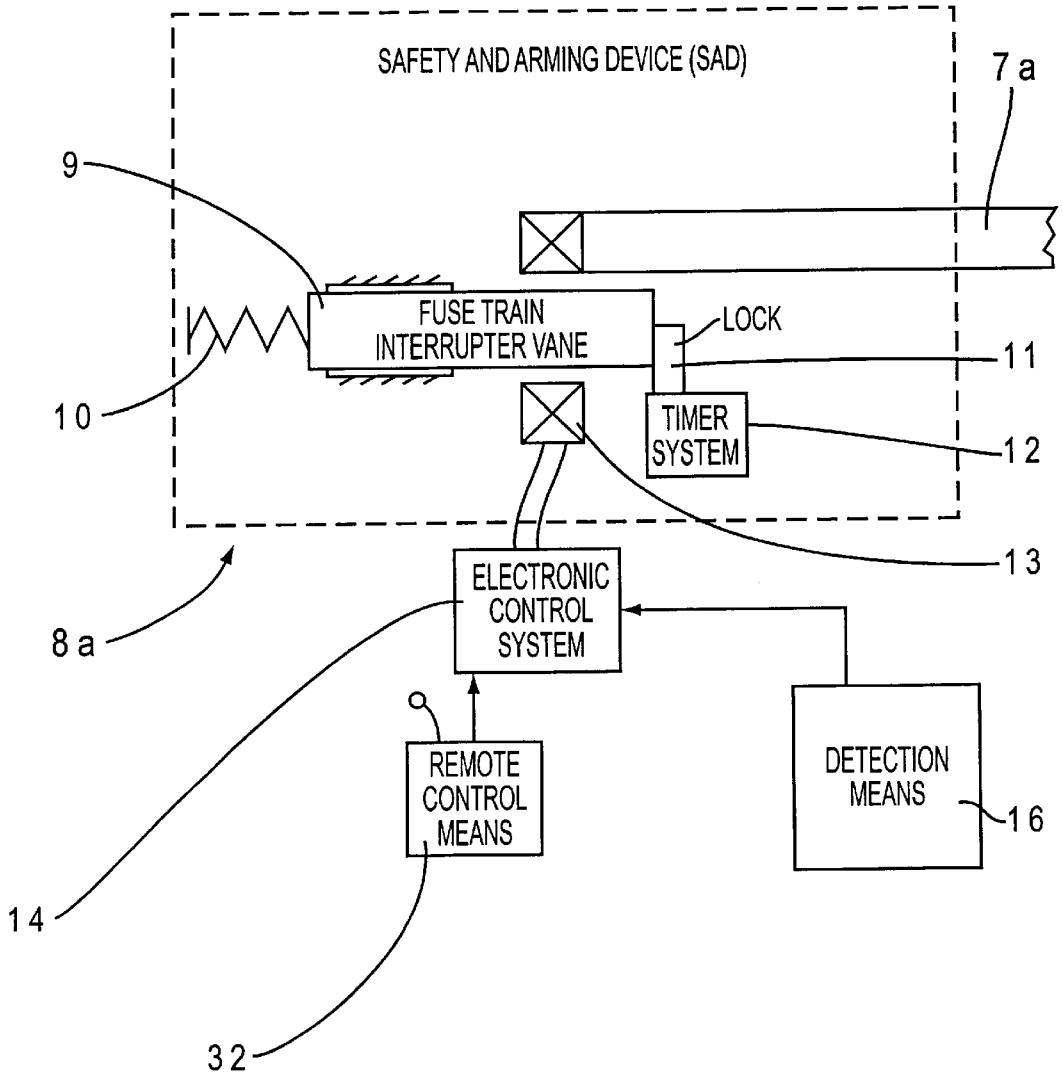

A safety and arming device (or SAD) 8 is schematically shown in FIG. 7. It comprises a fuse train interrupter vane 9 that can slide using motor means 10 and that is held in a safety position by a lock 11 whose retraction is controlled by a timer system 12 of a known type (electronic or mechanical). The SAD 8 also encloses an electrically-initiated primer 13 that is connected to an electronic firing control system 14 that includes a power source such as a battery (the power source can also be external to the SAD). The latter is shown schematically in the figures in the form of a case 14 integral with a lower face of the casing 1.

The primer 13 is intended to ignited the primacord 7 one end of which thus penetrates inside the SAD.

The timer system will be advantageously controlled by the electronic system 14 that can comprise a push button 31 enabling the different SADs to be armed manually after the casing has been set into position on the vehicle. Means 32 can also be provided to receive remote-controlled commands (by radio, for example) that will enable the different vanes of the SADs to be moved at will and at a distance from a safety position into an armed position, or vice versa.

The electronic control system 14 receives a signal to trigger firing that is supplied by the detection means 16.

According to the embodiment shown in FIGS. 1*a* and 1*b*, the detection means 16 comprise four independent detector panels 17*a*, 17*b*, 17*c* and 17*d*.

The detector panels are arranged inside casing 1 and are thus protected from external stresses by the cover 1*a* of the casing. Advantageously, these panels can be embedded by duplicate-molding in the material of the cover.

The cover 1*a* will be of a thickness selected such that the panels can not be triggered by an inadvertent shock or by the impact of a small-caliber projectile.

The impact of a kinetic projectile (core or APFSDS) on one of the panels enables which part of the casing the projectile is penetrating to be determined and thus to know which two linear charges are the closet to the impact.

Thus an impact on panel 17*a* will enable the electronic system to deduce that the charges that are nearest to the point of impact are charges 4*a* and 4*d*. An impact on panel 17*c* leads to the deduction that the nearest dihedral charges are charges 4*b* and 4*c*.

Figure 4:
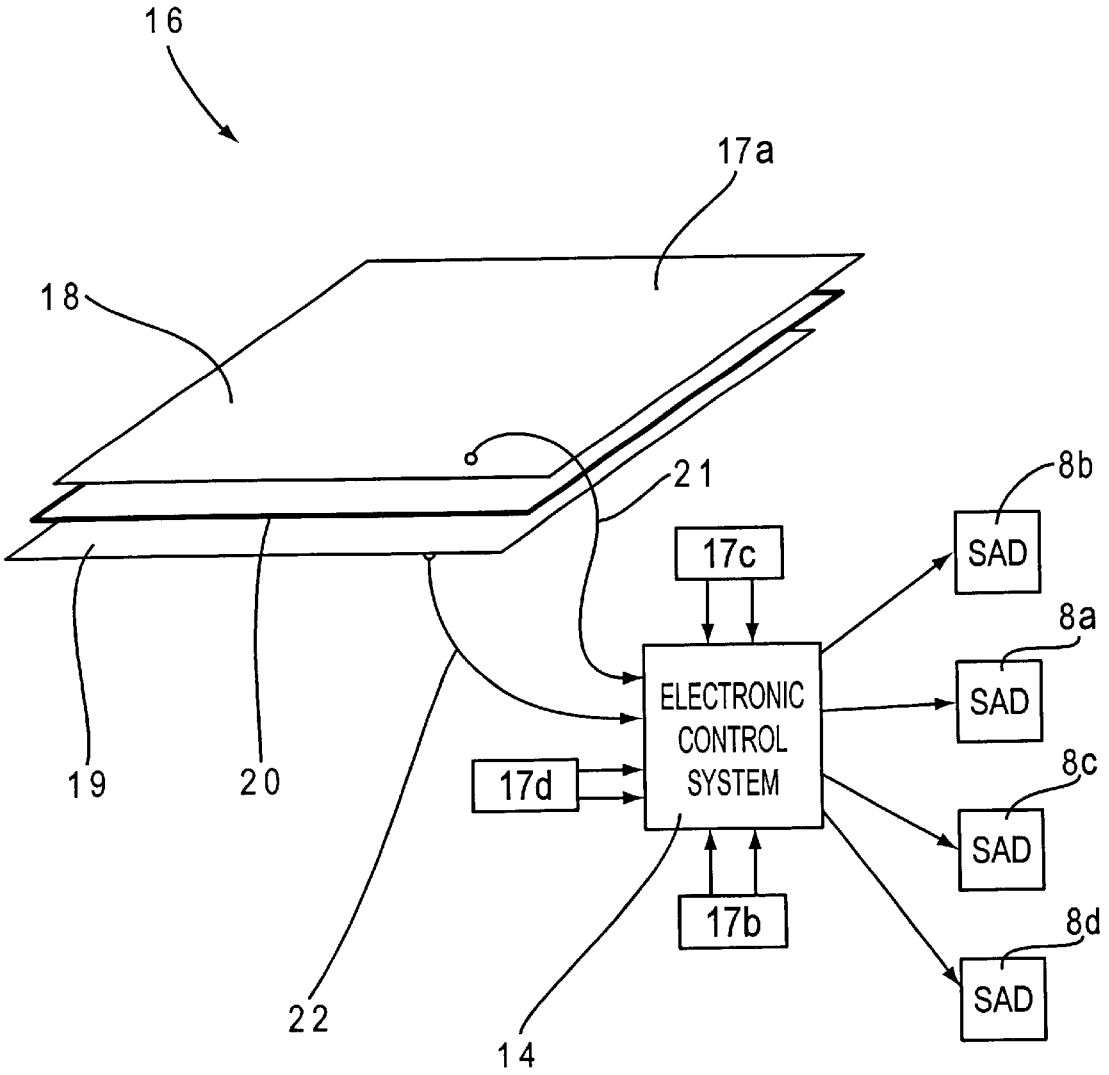
FIG. 4 shows details of a first embodiment of detection means.

FIG. 4 schematizes a particular embodiment of a detection panel 17. This panel comprises a first sheet 18, for example of aluminum, and a second sheet 19 also of aluminum. The two sheets are electrically insulated from one another by a sheet of a plastic material 20 (for example, in polyethylene). Each sheet is connected by a conductor 21, 22 to the electronic control system 14. The latter is thus connected to the conductive sheets of the four panels 17*a,* 17*b*, 17*c* and 17*d*.

When a projectile impacts on a panel, the conductive sheets and the insulating sheet are torn. This results in the establishment of an electrical contact between the electric contacts formed by the sheets 18 and 19. The electronic control system 14 detects this contact and locates the panel in question.

It determines the charges 4 that are nearest to this panel and firstly controls the ignition of these charges via primers 13 arranged in the associated SADs 8.

The two other charges 4 will be ignited thereafter and sequentially after a predetermined delay according to the threat and in the order of magnitude of 10 to 100 microseconds.

The delay will preferably be an electronic delay integrated to the control system 14. It can be pre-programmed or else programmed when the device is being set into position or else programmed further to the detection of a specific threat.

By way of a variant, in this embodiment comprising 4 panels 17, the central electronic system 14 could be replaced by four independent, simplified control systems that will each be integrated with a SAD 8.

Figure 8:
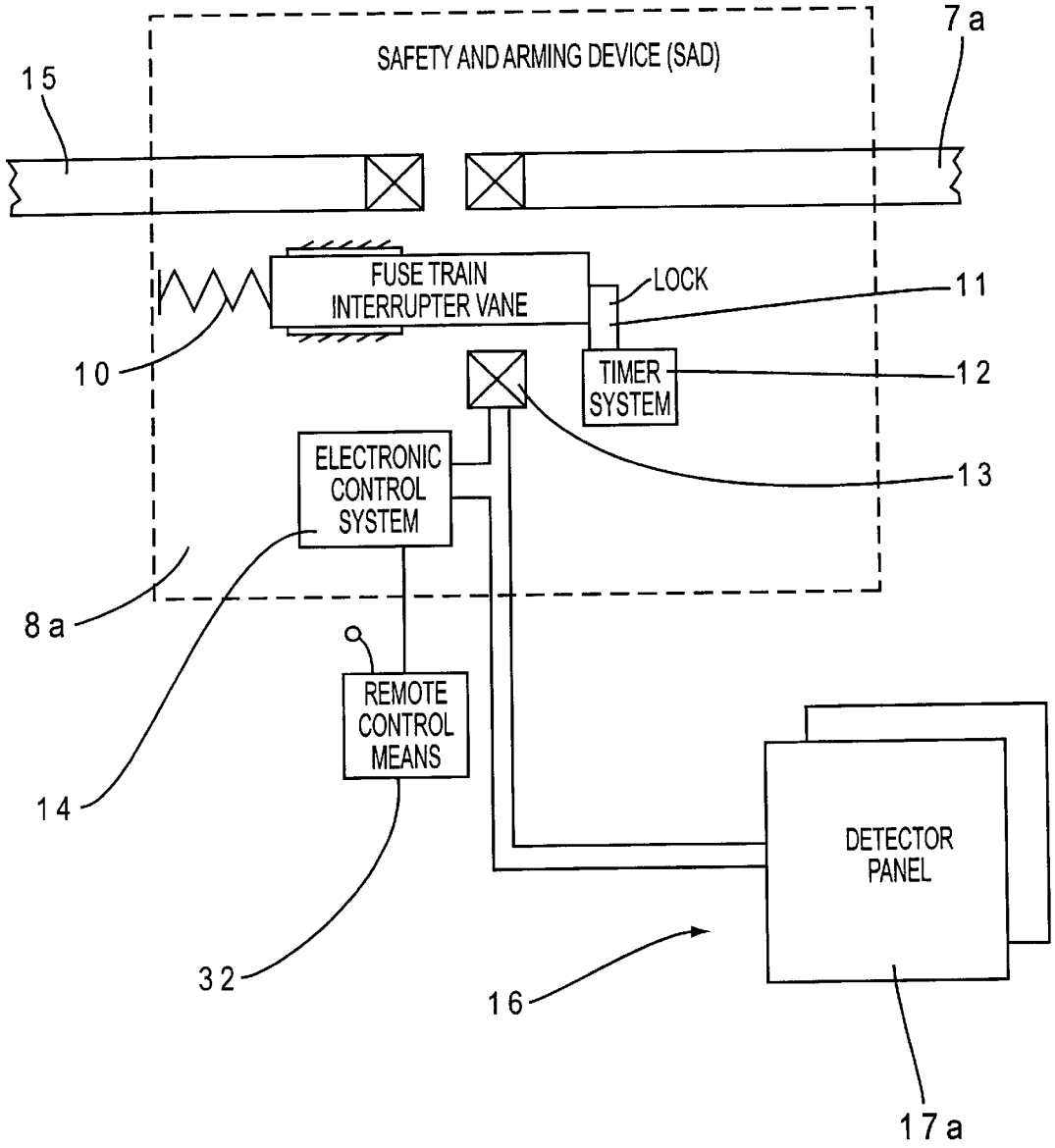
FIG. 8 schematically shows a variant embodiment of a safety and arming device for one of the shaped charges.

FIG. 8 shows such a variant embodiment. In this case, each SAD 8 integrates a local control system 14 that comprises a source of electric power and possibly also an electronic safety device and means 32 to receive the remotely-controlled arming command.

In this case, each panel 17*a*, 17*b*, 17*c* and 17*d* will be connected to a single SAD 8*a*, 8*b*, 8*c* or 8*d* respectively. The detection of a projectile impacting on a panel will cause the ignition of the dihedral charge associated with the panel.

Primer 13 also causes the ignition of a pyrotechnic delay cord 15 (for example, a cord of penta-erythrityl tetranitrate (PET) or a pyrotechnic delay composition such as the type described in patent FR-A-2,650,589 and combining tungsten/barium chromate and potassium percholorate) that connect the different SADs and that ensure the sequential ignition, further to the ignition of a single primer 13, of the four dihedral charges. The cords will be defined such as to ensure delays between each charge ignition of around 10 to 100 microseconds.

Figure 5:
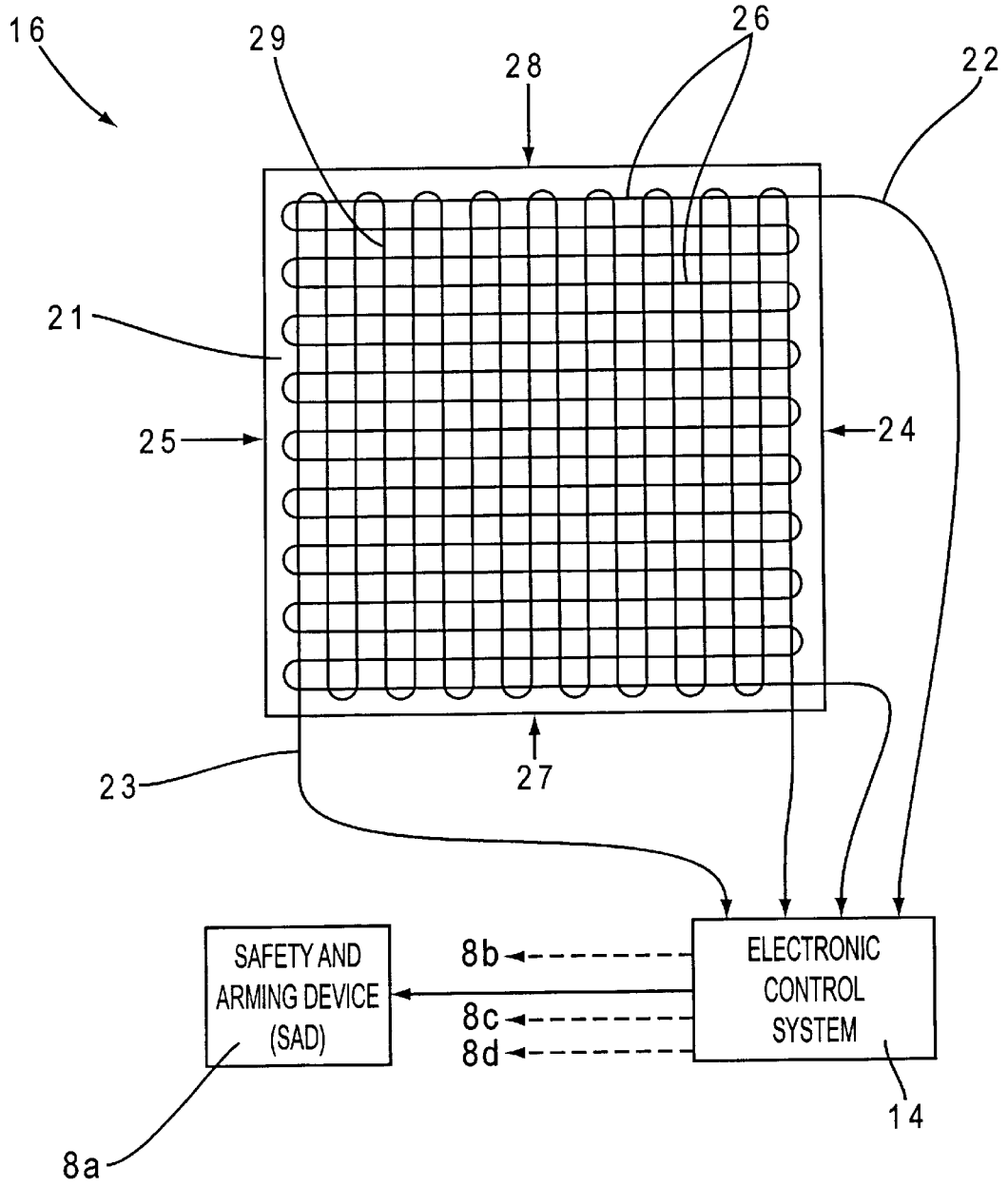
FIG. 5 shows a second embodiment of detection means.

FIG. 5 shows a second embodiment of detection means 16. These means comprise a single panel 21 that incorporates two continuous bifilary conductive cables 22 and 23 bonded to the panel 21.

The cable 22 goes alternatively from a first edge 24 of the panel 21 to a second edge 25 parallel to the first thus making a cover for the panel in the form of a network 26 of lines substantially parallel to one another.

The cable 23 goes alternatively from one edge 27 of the panel 21 to an edge 28 parallel to the first thus making a cover for the panel by a network of lines 29 substantially parallel to one another and perpendicular to the lines 26 of the first network.

The two cables 22 and 23 thus form a grid over the surface of the panel.

The ends of the two cables 22 and 23 are connected to the electronic control system 14 that incorporates means enabling the measurement of the electrical resistance or conductivity of the cables.

A projectile impacting on the panel 21 will cause the breakage of cables 22 and 23.

The system 14 ensures the measurement of the electrical resistance of the cables 22 and 23. Upon breakage this resistance is modified (reduced), the projectile causing a momentary short circuit of the two cables at the impact point.

As the resistance of a conductive cable is proportional to its length, appropriate programming of the system 14 based on the measurement of the resistance during the impact of a projectile will enable the length of the portions of cables located between the control system 14 and the impact point to be measured, and therefore the coordinates of the point of impact of the projectile on the panel 21 to be deduced.

The system 14 will deduce which dihedral charge 4 is nearest to the point of impact. This will be ignited first, the three other charges will thereafter be triggered sequentially by means of an electronic delay or a pyrotechnic delay as has been described previously.

By way of a variant, it is possible to make four detection panels, each incorporating at least one cable broken by the impacting projectile. The detection of an impact on one of the panels will thus cause the ignition of the shaped charge or charges in the vicinity of said panel.

The detection systems described with reference to FIGS. 4 and 5 are well known to the expert in the field of projectile firing metrology. They will therefore not be described here in any further detail.

Such an active protection device operates as follows.

As has been specified above, the cover 1*a* is dimensioned so as to be able to withstand the impacts of small-caliber projectiles (the cover will, for example, have a thickness of light alloy or composite material of around 5 to 10 mm). Thus, the detection system of the protection device will only be activated by the impact of a high energy kinetic projectile such as an APFSDS or core from a shaped charge. To increase the safety of the device, it can be kept unarmed until a threat has been detected and identified by the vehicle commander.

The impact of such a kinetic projectile is detected by one of the panels of the detection device. According to the solution retained for this device, the impact will be located in one of the four quadrants of the casing (four-panel detector in FIG. 4) or else in the vicinity of one of the dihedral charges (detector according to FIG. 5).

The dihedral charge nearest to the point of impact or else the one that is arbitrarily associated to one of the detection panels is then ignited. With a very short delay with respect to the detection of impact (in the region of a few microseconds), it generates a dihedral jet that intercepts the kinetic projectile. The three other dihedral shaped charges are ignited sequentially with a delay of around 10 to 100 microseconds. The different jets impact the kinetic projectile and cause it to be sectioned and destabilized. This seriously reduces its piercing effectiveness with respect to the vehicle wall.

A single dihedral charge is enough to destabilize the slug of a shaped charge. Trials have thus been able to demonstrate that a hollow charge 35 mm in diameter (100 g of explosive) can section a slug of a shaped charge that is 80 mm long and has a velocity of 2,400 m/s.

The combination of several dihedral charges (and notably the four charges described above) enable long-length projectiles (APFSDS projectiles) to be sectioned thereby strongly reducing their effectiveness.

The protection device according to the invention is thus very effective against kinetic projectiles whilst implementing only a restricted mass of explosive (of around 400 g for a casing of dimension 200 mm×200 mm). It is lightweight and can therefore be set into position on a vehicle roof to protect it against overflight attack ammunition.

Figure 2:
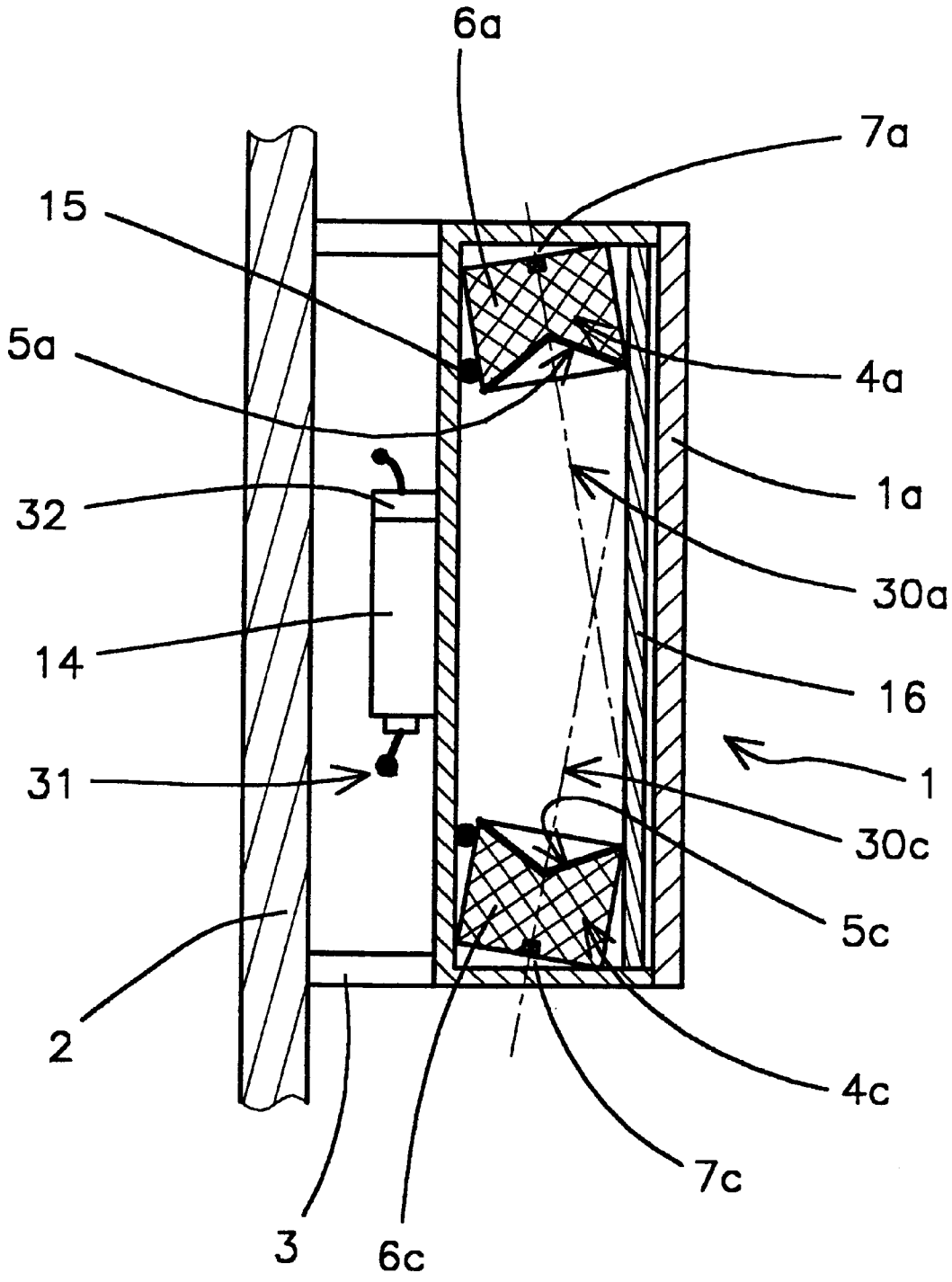
FIG. 2 is a section view of a variant embodiment of his same casing.

FIG. 2 shows a variant embodiment of such a protection system, such variant wherein the four dihedral charges 4*a*, 4*b*, 4*c* and 4*d* have their directions of action 30*a*, 30*b*, 30*c* and 30*d* inclined with respect to the wall 2 of the vehicle and oriented towards the outside of the vehicle.

Such an arrangement enables the projectile to be intercepted much further away from the vehicle and allows a reduction in the rear effects on the latter.

Figure 3A:
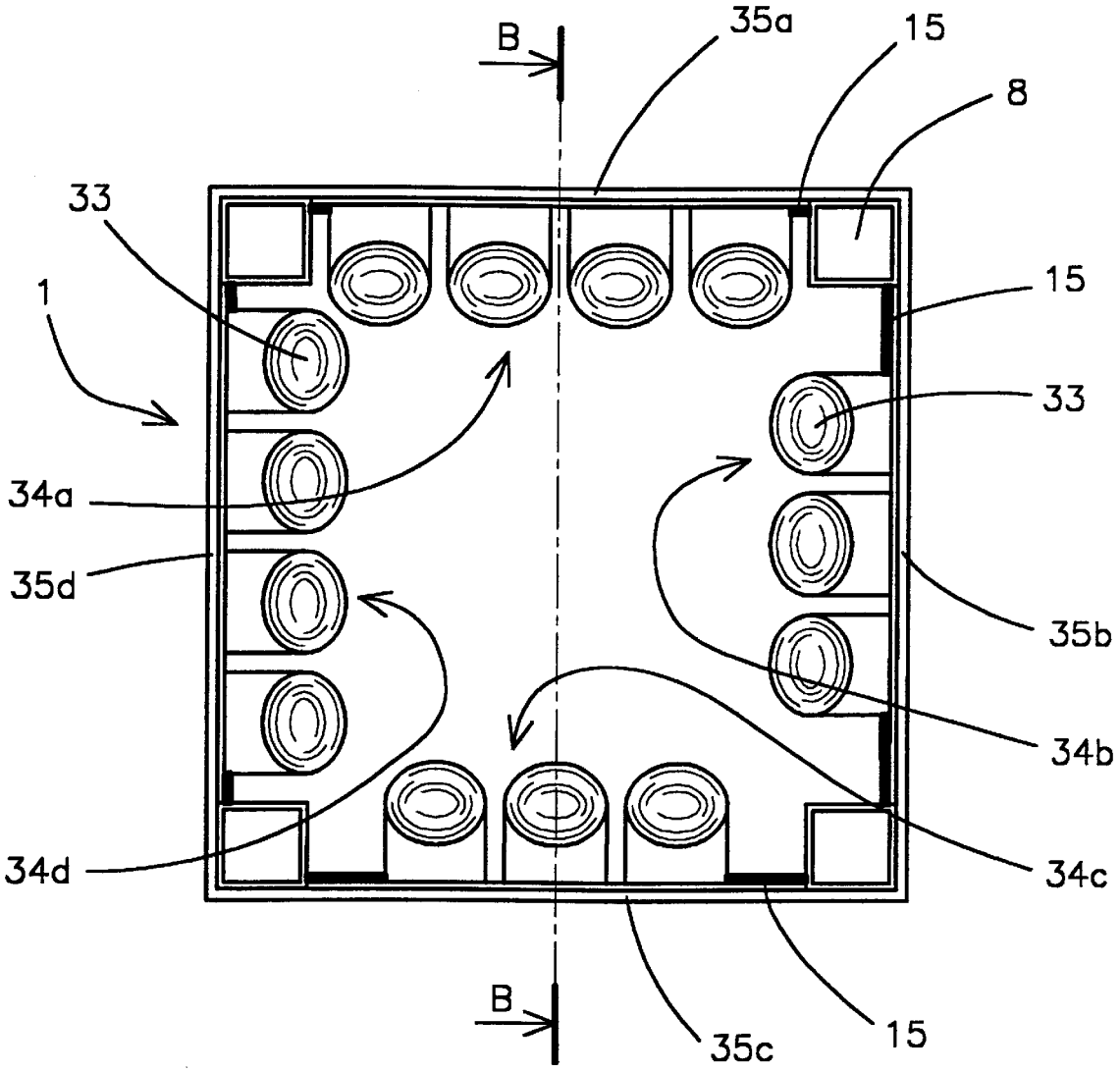
FIG. 3*a* is a front view of a casing according to another embodiment of the invention.
Figure 3B:
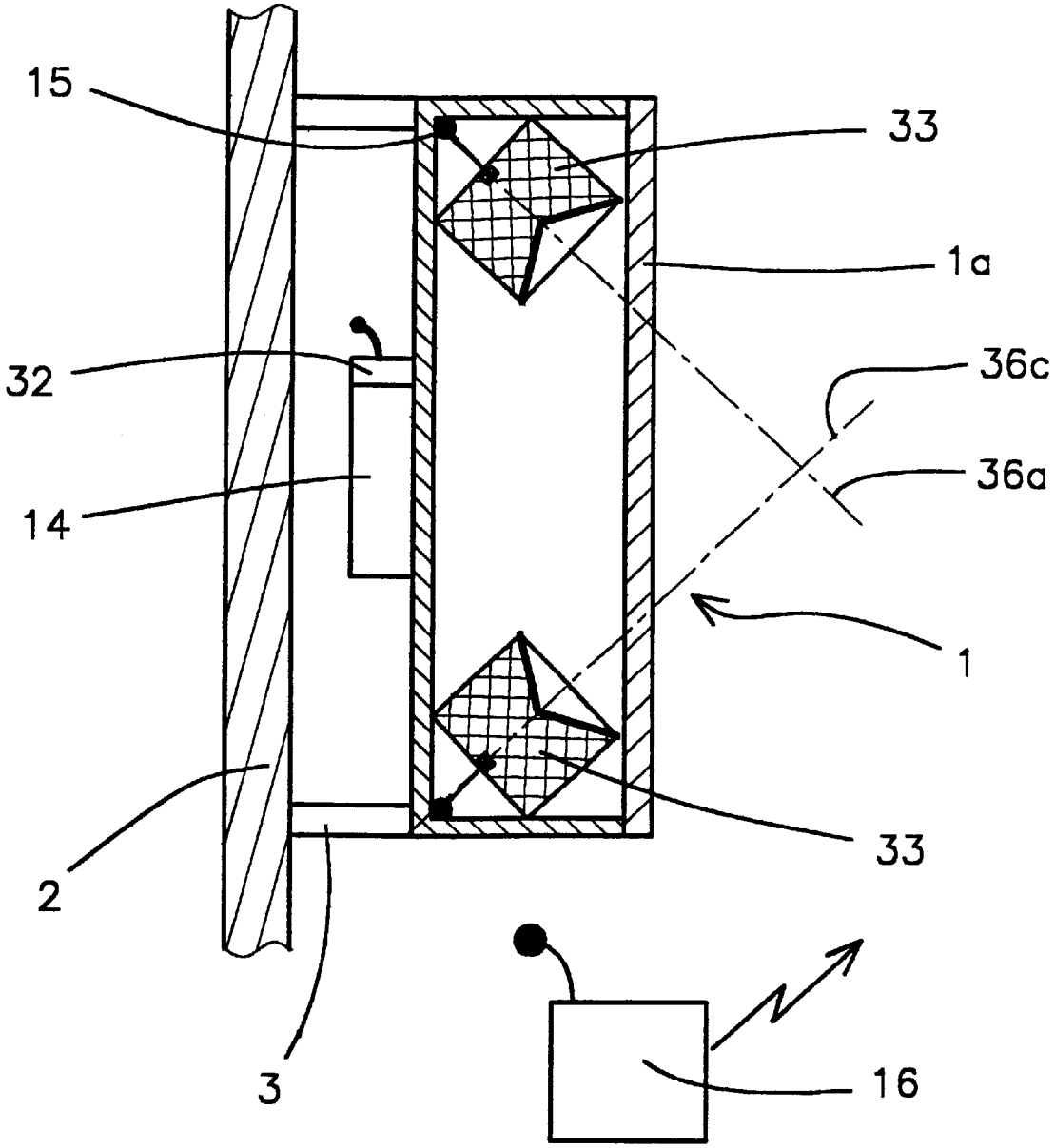
FIG. 3*b* is a section view of this same casing along plane BB as shown in FIG. 3*a,*

A second embodiment of the invention is shown in FIGS. 3*a* and 3*b*.

This embodiment is more particularly intended to protect a vehicle against shaped charge warheads and notably tandem charge warheads. It differs from the previous one in that the dihedral charges are replaced by small cylindrical shaped charges 33 (around 40 mm in caliber) arranged in the vicinity of the inner walls of the casing 1. The shaped charges 33 are arranged in four rows 34*a*, 34*b*, 34*c* and 34*d*, each row being associated with one of the inner walls 35*a*, 35*b*, 35*c* and 35*d* of the casing 1.

The charges 33 of a single row are all parallel to one another and the directions of action of the different shaped charges (the axes of the shaped charges) are inclined with respect to the wall 2 of the vehicle.

The directions of action of the charges arranged on the single side of the casing thus form a plane of attack.

The paths of the plane of attack of the rows of charges 34*a* and 34*c* are shown by lines 36*a* and 36*c* on FIG. 3*b* (and are identical to the directions of action of the charges 33 that can be seen in FIG. 3*b*). The different planes of attack intersect outside the casing 1 and at a distance from its cover 1*a* of around 1 caliber of shaped charge.

Moreover, the rows of charges 33 arranged in the vicinity of the walls 35 of the casing 1 that are parallel do not have the same number of charges and the axes of the different charges are offset alternatively with respect to one another. Thus, row 34*a* incorporates four charges whereas the row opposite 34*c* only incorporates three. Similarly, row 34*d* incorporates four charges whereas row 34*b* incorporates three.

The different charges are ignited by delay cords 15, themselves ignited by a primer placed in a safety and arming device 8.

An electronic control device 14 ensures the ignition of the different charges in response to a firing command supplied by the detection means 16 arranged at a distance from the casing.

The electronic control system 14 will be fitted with means 32 to receive remote-controlled commands which will also ensure the reception of the firing command emitted by the detection means 16.

These means are formed so as to be able to detect an approaching shaped charge projectile such as a missile or a rocket (projectile velocity of around 200 to 800 m/s).

They can comprise one or several radar detectors and/or one or several optical detectors, and they will also comprise computation means enabling the projectile velocity to be determined and thus the optimal ignition time for the shaped charges to be deduced.

The active protection device operates as follows.

In response to the identification of a threat by the detection of an approaching projectile such as a missile or rocket in the vicinity of the casing, these detection means 16 control the ignition of the protection device at the optimum time.

The ignition time is determined by means of computation algorithms as a function of the velocity measured for the projectile and of its distance from the wall. The ignition of the shaped charges is caused at such a time that the projectile that has been detected is as a distance from the casing of between 0.5 m and 2 m.

The electronic control system will ignite the different rows of shaped charges sequentially. All the shaped charges of a single row will be ignited simultaneously, the other rows being ignited successively with an ignition delay of around 20 to 50 microseconds.

Because of the multiplication in the number of shaped charges 33 as well as the spatial offsetting of the different axes of the charges, the probability of intercepting the projectile is improved. It is further improved by the staggered ignition times from one row to another.

The destruction of the incident projectile is thus ensured well before it impacts on the casing.

Effectiveness is thus ensured even against tandem shaped projectiles and this at a relatively restricted protection casing mass (around 4 kg).

By way of a variant, a different number of shaped charges 33 can be adopted. The shaped charges can also be arranged in several parallel rows, for example two rows of charges in the vicinity of each casing wall, that is eight rows of shaped charges in all. In this case, the charges will be placed integral to a same wall in two overlapping rows so as to increase the probability of the device intercepting a projectile. The two rows of charges of a single wall can be ignited simultaneously or else sequentially.

Such a protection device is only effective if the projectile has a trajectory that brings it into the zone of effectiveness of the casing.

It is thus preferable for several casings to be associated distributed over different walls of the vehicle with centralized detection means that will determine which of the casings must be ignited further to an approaching threat.

Figure 6A:
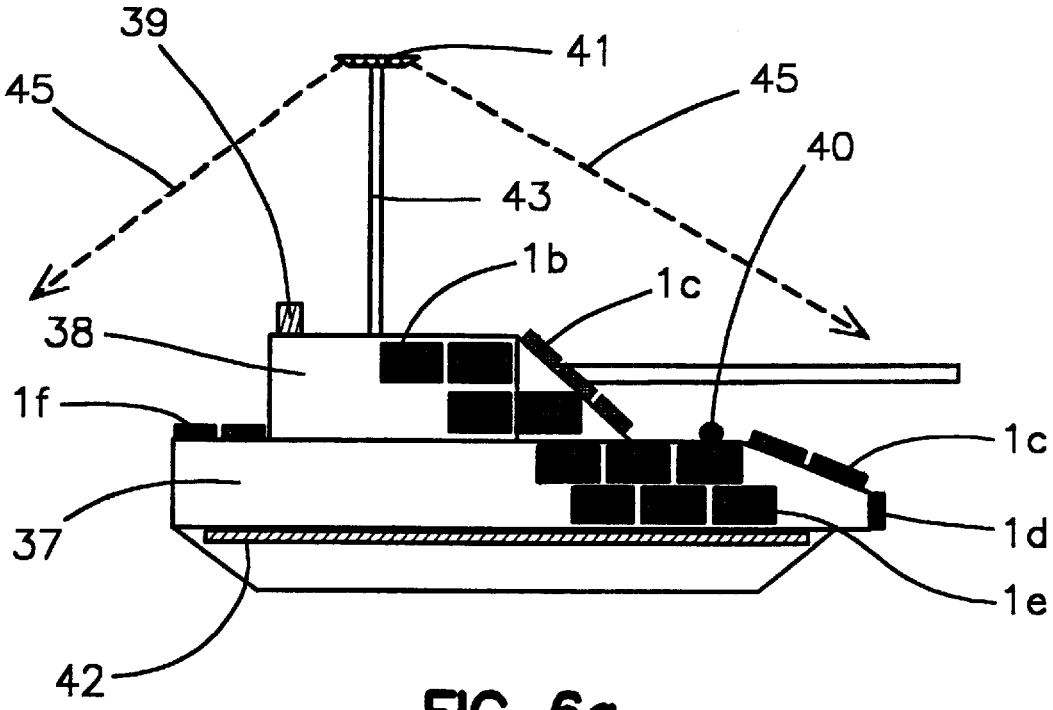
FIG. 6*a* and 6*b* show a vehicle along two orthogonal directions of observation that is fitted with a protection device according to the invention and using detection means according to a third embodiment, FIG. 7 schematically shows a safety and arming device for one of the shaped charges.
Figure 6B:
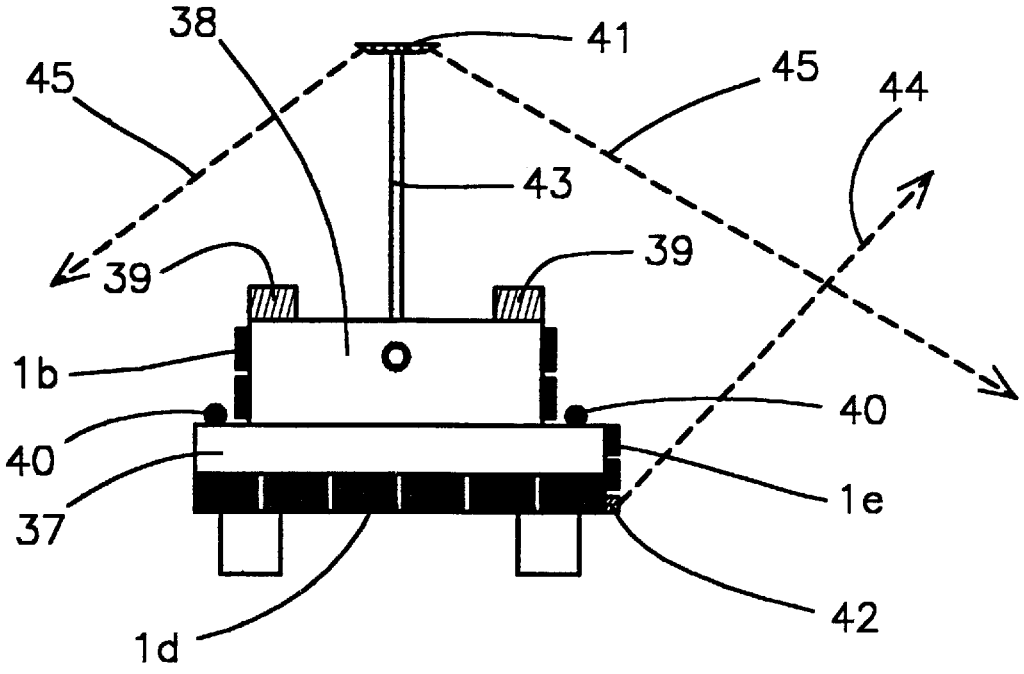

FIGS. 6*a* and 6*b t*hus show an armored vehicle 37 that incorporates several protection casings 1.

On the Figure can be seen:

casings 1*b* arranged laterally on the turret, casings 1*c* arranged on the glacis, casings 1*d* arrange on the front part, casings 1*e* arranged on the track side protectors, casings if arranged to protect the engines.

The vehicle is fitted with centralized detection means ensuring the surveillance (alert) of the immediate environment of the tank and the tracking of the projectile (trajectory plotting). These means are designed either to simultaneously ensure both surveillance and tracking function, or they are able to quickly switch from the surveillance mode into the tracking mode. They can comprise:

proximity radar 39 arranged on the turret (as in the example shown here), charge transfer optical cameras 40 (CCD) or fast infrared cameras one or several optical barriers 41, 42.

Lateral optical barriers can be provided in the form of sensor blocks (infrared or laser diodes). These blocks will detect the approaching projectiles attacking the vehicle from the side (detection direction 44). The sensors detecting the approaching projectile will localize its direction of attack. A central computer that coordinates the different detection means will thereafter deduce the active casing or casings that must be ignited.

A tapered beam roof block 41 can also be provided (in addition to or in replacement of the lateral blocks) that will be integral with a telescopic mast 43 (detection directions 45).

It is naturally also possible to associate anti-shaped-charge protection casings (FIGS. 3*a*, 3*b*) and anti-kinetic projectile casings (FIGS. 1*a*, 1*b*, 1*c*) on the same vehicle.

The protective device according to the invention can also naturally be adapted to the wall of a fixed structure such as a building, a hangar, a mobile unit (such as a command post or communications relay post).

What is claimed is:

1. An active protection device, comprising:

a quadrilateral casing having a base surface;

a plurality of shaped charges having a direction of action substantially parallel to or else inclined with respect to said base surface; and detection means for ensuring the triggering of at least one shaped charge of said plurality of shaped charges in reply to the onset of a projectile, wherein the plurality of shaped charges are arranged in the quadrilateral casing, with at least one shaped charge being arranged on each side of the quadrilateral casing.

2. An active protection device according to claim 1, wherein the plurality of shaped charges comprise four dihedral shaped charges, a dihedral shaped charge at each side of said quadrilateral casing and the four dihedral shaped charges having converging directions of action.

3. An active protection device according to claim 2, wherein said directions of action of the shaped charges are inclined with respect to said base surface and oriented away from said base surface.

4. An active protection device according to claim 2, wherein said detection means comprise four independent contact panels, each panel controlling the triggering of a different dihedral shaped charge of the four dihedral shaped charges.

5. An active protection device according to one of claim 2, wherein delay means are provided to ensure the sequential ignition of said other three dihedral shaped charges after the ignition of said dihedral shaped charge.

6. An active protection device according to claim 2, wherein the active protection device incorporates at least two quadrilateral casings and wherein said detection means comprise at least one electromagnetic or optical central sensor, said sensor being connected to computation means that determines the approach direction of said projectile and its velocity and that controls the ignition of at least one said charge from one of said quadrilateral casings.

7. An active protection device according to claim 1, wherein said detection means comprise at least one panel comprising at least two electrical contacts closed off by the impact of said projectile.

8. An active protection device according to claim 7 wherein said detection means comprise four independent contact panels, each panel controlling the triggering of a different dihedral shaped charge of the four dihedral shaped charges.

9. An active protection device according to claim 1, wherein said detection means comprise at least one panel incorporating at least one conductor cable broken by an impacting projectile.

10. An active protection device according to claim 9, wherein said detection means can comprise at least two cables broken by the impact of said projectile, each cable being arranged such as to go alternatively from a first edge of said panel to a second edge parallel to the first edge making a cover of said panel by means of a network of substantially parallel lines, the lines of said network being formed by a first cable being perpendicular to those of said network formed by a second cable such as to form a grid on said panel surface.

11. An active protection device according to claim 10, wherein said detection means comprise a control system to ensure measurement of the resistance of said detection cables, such as to locate the impact point of said projectile on said panel, and that controls the triggering of said at least one shaped charge nearest the point of impact.

12. An active protection device according to claim 9, wherein the quadrilateral casing encloses a plurality of cylindrical shaped charges, at least two rows of the cylindrical shaped charges arranged on each side of the quadrilateral casing and the directions of action of each cylindrical shaped charge being inclined with respect to the base surface.

13. An active protection device according to claim 1, wherein said quadrilateral casing encloses the plurality of shaped charges comprising at least four cylindrical shaped charges, at least one cylindrical shaped charge of said at least four cylindrical shaped charges being arranged on each side of the quadrilateral casing and the directions of action of said at least four cylindrical shaped charges being inclined with respect to said base surface.

14. An active protection device according to claim 13, wherein the active protection device incorporates at least two quadrilateral casings and wherein said detection means comprise at least one electromagnetic or optical central sensor, said sensor being connected to computation means that determines the approach direction of said projectile and its velocity and that controls the ignition of at least one said charge from one of said quadrilateral casings.

15. An active protection device according to claim 13, wherein at least two cylindrical shaped charges are arranged along each of two sides of the quadrilateral casing, the two sides orthogonal to one another, and at least one cylindrical shaped charge is arranged on each of the remaining two sides of the quadrilateral casing, a side having at least one cylindrical shaped charge opposing a side having at least two cylindrical shaped charges.

16. An active protection device according to claim 15, wherein the at least two cylindrical shaped charges comprise at least four cylindrical shaped charges and the at least one cylindrical shaped charge comprises at least three cylindrical shaped charges.

17. An active protection device according to claim 13, wherein said detection means comprise at least one panel comprising at least two electrical contacts closed off by the impact of the projectile.

18. An active protection device according to claim 17, wherein said detection means comprise four independent contact panels, each panel controlling the triggering of a different set of the at least one cylindrical shaped charge.

* * * * *